US006744695B2

(12) United States Patent
Goldberg

(10) Patent No.: US 6,744,695 B2
(45) Date of Patent: Jun. 1, 2004

(54) PLANISPHERE WATCH

(76) Inventor: Alex Goldberg, 23121 Antonio Pkwy., Suite 135, Rancho Santa Margarita, CA (US) 92688

( * ) Notice: Subject to any disclaimer, the term of this patent is extended or adjusted under 35 U.S.C. 154(b) by 372 days.

(21) Appl. No.: 09/997,280

(22) Filed: Nov. 20, 2001

(65) Prior Publication Data

US 2003/0095475 A1 May 22, 2003

(51) Int. Cl.[7] ..... G04B 19/22; G04B 19/26; G04B 49/00

(52) U.S. Cl. ..... 368/15; 368/27

(58) Field of Search ..... 368/14–21, 27, 368/223

(56) References Cited

U.S. PATENT DOCUMENTS 1,153,492 A * 9/1915 Hoitinga ..... 368/16
4,435,795 A * 3/1984 Frank ..... 368/16
4,711,583 A * 12/1987 Oechslin et al. ..... 368/16
4,731,767 A * 3/1988 Uehara ..... 358/15
5,253,225 A * 10/1993 Vaucher ..... 368/20
5,457,663 A * 10/1995 Mejaski ..... 368/15
5,519,673 A * 5/1996 Uehara et al. ..... 368/15

* cited by examiner

*Primary Examiner*—Vit W. Miska
(74) *Attorney, Agent, or Firm*—Kelly Bauersfeld Lowry & Kelley, LLP

(57) ABSTRACT

A planisphere watch includes a watch case having a transparent lens. A time keeping mechanism is disposed within the case and has a time display viewable through the lens. A planisphere map of star constellations and star systems is viewable through the lens. A rotatable bezel overlies the lens and defines a window through which a portion of the planisphere is viewed. The bezel includes time indicia alignable with date indicia imprinted onto an underlying tension ring. Rotating the bezel to align a selected time with a selected date reveals a portion of the planisphere map viewable in the night sky at that selected time and date.

20 Claims, 3 Drawing Sheets

PLANISPHERE WATCH

BACKGROUND OF THE INVENTION

The present invention is concerned with planispheres. More particularly, the present invention is concerned with a planisphere built into a watch.

Planispheres comprise a polar projection of a celestial sphere and stars on a plane with adjustable circles or other appendages for showing celestial phenomenon for any given time. There exist a number of plastic and paper planispheres. These typically consist of paper or plastic discs with die-cut thumb wheels. The discs are rotated with the thumb and aligned with the time printed on a paper or plastic top card in order to reveal the orientation of the celestial bodies at that given time. Planispheres are made separately for the Northern and Southern hemispheres as the perspective of the viewer is different on either hemisphere.

However, there currently does not exist a planisphere which is incorporated into a watch. The present invention fulfills this need and provides other related advantages.

SUMMARY OF THE INVENTION

The present invention resides in a planisphere which is incorporated into a watch. The planisphere watch generally comprises a watch case including a transparent lens. A time keeping mechanism is disposed within the case and has a time display viewable through the lens. The time keeping mechanism and the time display can be any one of various types as known in the art, although in a particularly preferred embodiment, the time display comprises a minute hand and a hour hand overlying a dial.

Planisphere indicia, comprising a map of star constellations and star systems, is either imprinted onto the lens or onto the dial so as to be viewable through the lens. The dial may be coated with a luminescent material to facilitate viewing of the planisphere.

A tension ring surrounds the lens and has date indicia thereon. The date indicia comprises the months of the year in sequence around the ring, and preselected dates of each month.

A movable bezel overlies the lens and defines a window through which a portion of the planisphere indicia is viewed. The bezel includes time indicia, typically consisting of the hours of 6 P.M. through 6 A.M., spaced from one another, alignable with the date indicia of the tension ring. The bezel includes an aperture alignable with a month of the tension ring, and preferably a series of circumferential apertures, each aperture being aligned with a month of the tension ring. The bezel also includes directional information for orienting the planisphere indicia relative to the night sky.

Upon rotating the bezel to align the selected time indicia of the bezel with the selected date indicia, the planisphere indicia viewable in the night sky at the selected time and date is viewable through the bezel window. The user of the invention can orient himself or herself using the directional information imprinted on the bezel and compare the planisphere map of the watch to the star constellations visible at that particular time of that particular night of the year.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
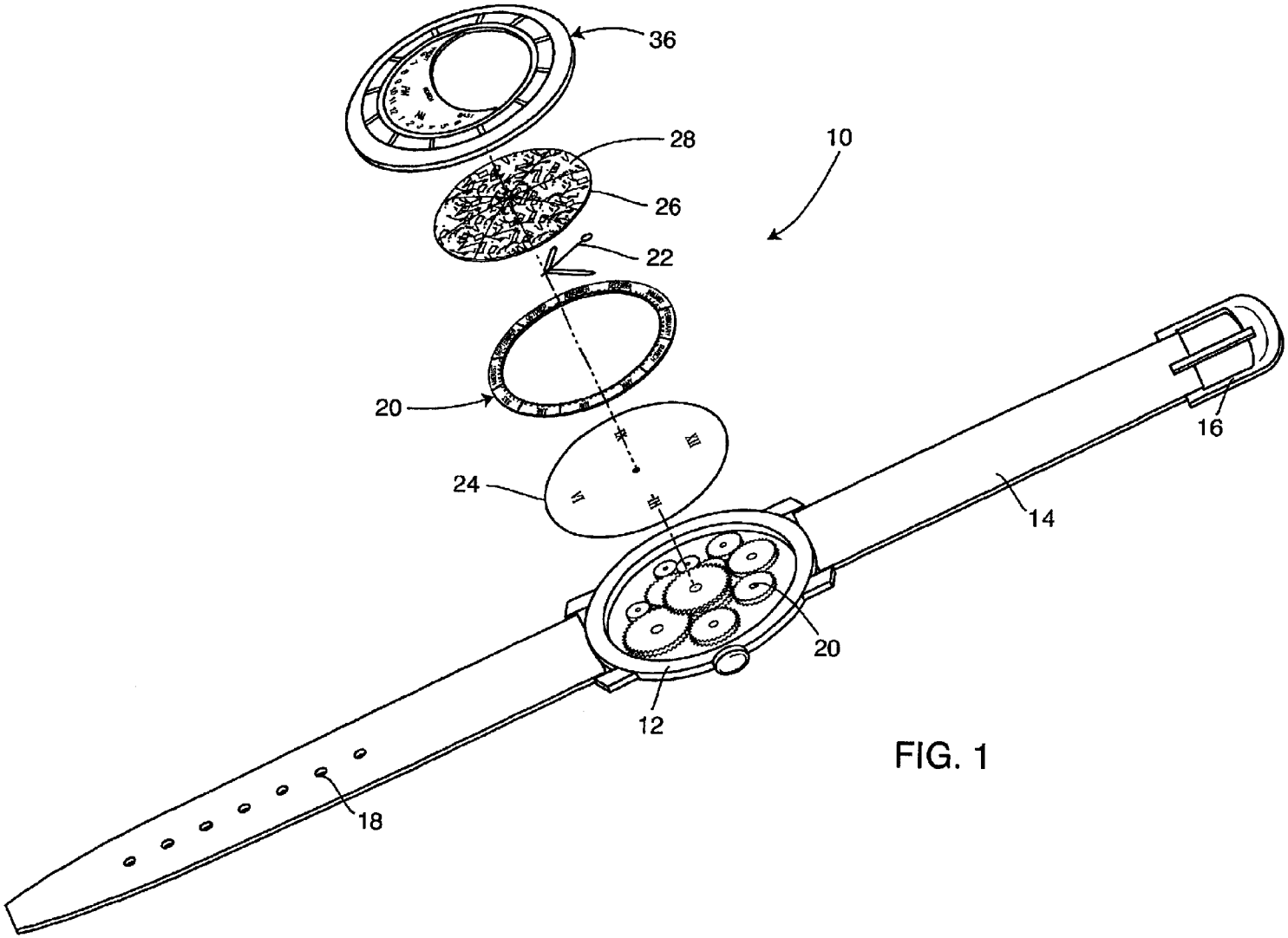
FIG. 1 is an exploded perspective view of a planisphere watch embodying the present invention, illustrating the various component parts thereof.

As shown in the drawings for purposes of illustration, the present invention resides in a planisphere watch, generally referred to by the reference number 10. The watch allows a user to determine the location of star constellations and star systems in the night sky at a given time and date of the year. As with any other watch, the planisphere watch 10 of the present invention also allows the user of the watch to determine the current time throughout the day and night.

With reference to FIG. 1, the planisphere watch 10 includes a watch case 12 comprised of metal or other durable material in standard fashion. A wristband 14 extends from the case 12 and can be comprised of any material known in the art, such as leather, plastic, rubber, metal-link, etc. Preferably, the wristband 14 is adjustable in length so as to fit users of different sizes, and to that end includes a latching clasp 16 which is insertable through one of a series of apertures 18 to fit the wristband 14 to the wrist of an individual. It will be understood that although the latching clasp 16 and apertures 18 are illustrated, any other of a number of watchbands and latching mechanisms can also be used with the present invention.

A time keeping mechanism 20 is disposed within the watch case 12 in order to keep accurate time, as is well known in the art. Although a mechanical movement is illustrated, preferably the watch 10 utilizes a quartz analog movement powered by a button cell battery as this has been found to be an extremely accurate and cost effective movement. However, any other time keeping mechanism, such as an expensive automatic quartz movement, can be used.

The watch 10 also includes a time display operably connected to the time keeping mechanism 20 to indicate the current time. Although any one of a number of displays can be utilized, including LED or LCD digital displays, preferably, the watch 10 includes hour/minute/second hands 22 overlying a dial 24 that covers the internal time keeping mechanism 20. The dial 24 may or may not include time indicia in the form of Arabic or Roman numerals, or other symbols representing time indicia, as well known in the art.

Figure 2:
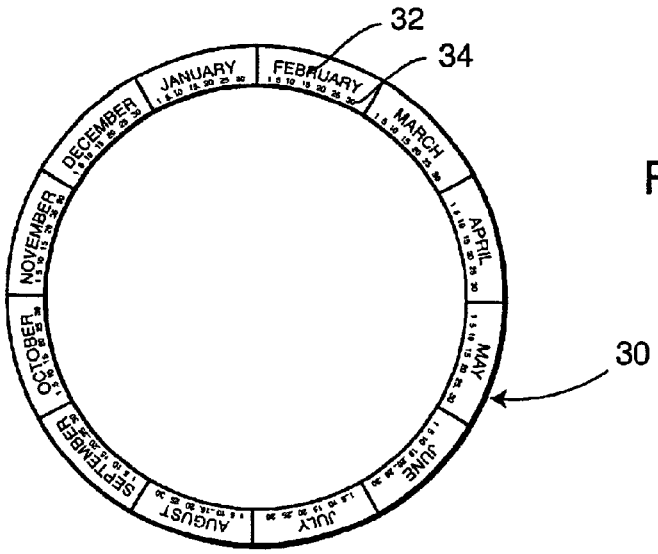
FIG. 2 is a top view of a planisphere map printed onto a lens of the watch.

Referring now to FIGS. 1 and 2, a lens 26, such as a transparent crystal domed lens, is attached to the case 12 so as to overlie the time display hands 22 and dial 24. In a particularly preferred embodiment, a planisphere map 28 is printed onto the lens 26. The planisphere map 28 includes star constellations, star systems, and other appropriate celestial bodies which can be viewable in the night sky during the year. Preferably, the various star constellations and systems are labeled on the planisphere map 28 for easy identification. For example, the "Big Dipper" will be illustrated by interconnected dots, representing the stars, and labeled accordingly on the planisphere map 28. Other star constellations will be similarly illustrated and identified. The planisphere map 28 is preferably printed onto the crystal lens 26 for better viewing and readability, although it should be understood that the planisphere map 28 can also be imprinted onto the dial 24. It will be appreciated by those skilled in the art that a different planisphere map 28 is required depending upon whether the user is in the Northern Hemisphere or the Southern Hemisphere.

Figure 3:
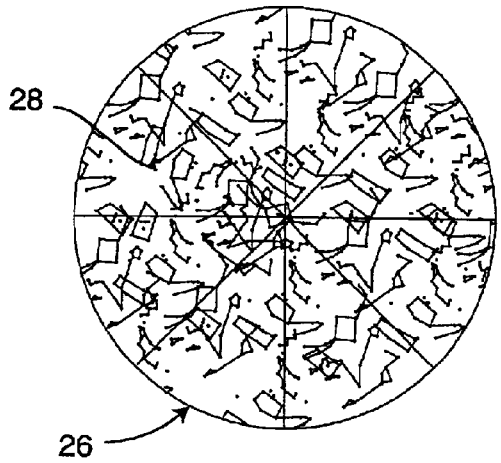
FIG. 3 is a top view of a tension ring having date indicia used in accordance with the present invention.

With reference now to FIGS. 1 and 3, a plastic or metal tension ring 40 is fixed to the case 12 and surrounds the lens 26. The tension ring 30 includes date indicia printed circumferentially around the tension ring 30, including months of the year 32 in sequence, and days of each month 34. Due to the limited space on the tension ring 30, only preselected days of the month 34 are actually printed, typically every five days of the month 32, the remainder of the days of the month 34 being represented by dots or other similar markings. Thus, all days 34 of each month 32 is shown in one form or another on the tension ring 30.

Figure 4:
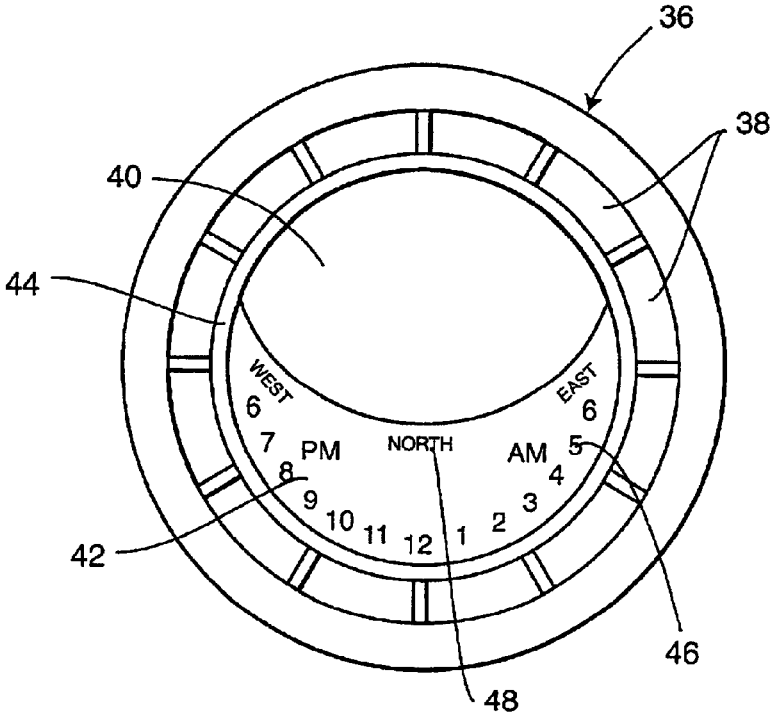
FIG. 4 is a top view of a bezel of the watch used in accordance with the present invention.
Figure 5:
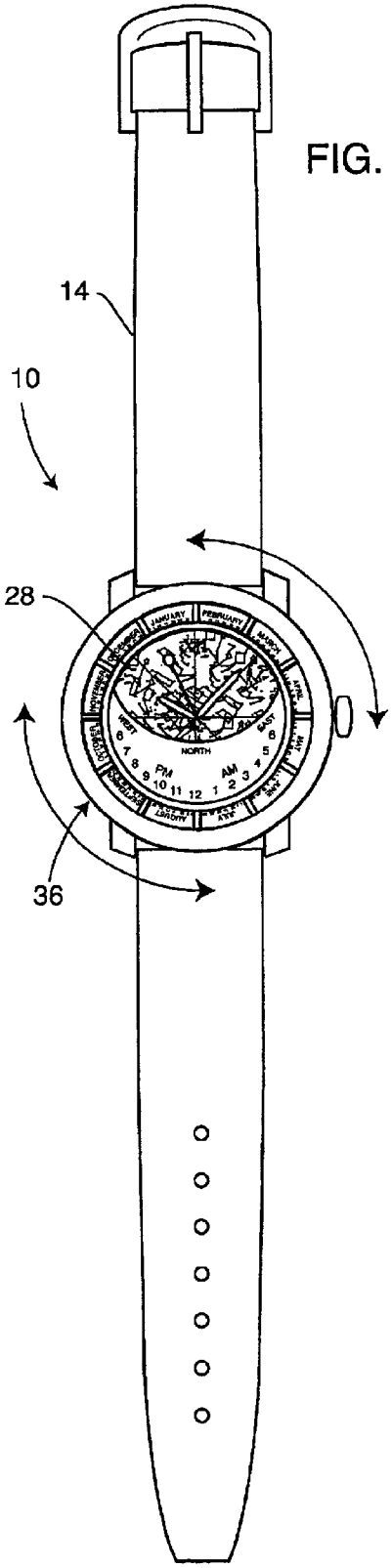
FIG. 5 is a top view of the planisphere watch of the present invention, illustrating the rotation of the bezel of FIG. 4 to indicate the planisphere indicia viewable in the night sky at that particular time and date.

Referring now to FIGS. 1 and 4, a bezel 36 is rotatably attached to the case 12, such as by bearings or having a lip thereof residing with a groove of the case 12, or any other manner of movably attaching the bezel 36 to the case 12. The bezel 36 overlies the tension ring 30 and lens 28. The bezel 36 includes a series of circumferential apertures 38 which are each sized and configured to be aligned with and overlie a month 32 of the tension ring 30. The bezel 36 also includes a transparent window or cutout 40 defined by an internal edge of a crescent-shaped opaque or solid section 42 and an internal ring 44 which serves as an internal boundary for the series of apertures 38. The opaque or solid crescent section 42 of the bezel 36 includes time indicia 46 consisting of the hours of 6 P.M., 7 P.M., 8 P.M., 9 P.M., 10 P.M., 11 P.M., 12 midnight, 1 A.M., 2 A.M., 3 A.M., 4 A.M., 5 A.M. and 6 A.M. spaced from one another on an outer edge of the crescent section 42. The bezel 36 also has imprinted or otherwise formed on the crescent section 42 directional information 48 on an interior edge of the crescent section 42 consisting of West, North and East, for the Northern Hemisphere; and East, South and West for the Southern Hemisphere.

Referring now to FIGS. 5-8, in use, the bezel 36 is manually rotated so that a preselected time of night according to the time indicia 46 is aligned with the proper month 32 and day of the month 34. A portion of the planisphere map 28 will be obstructed from view by the crescent section 42. The remainder of the planisphere map 28 will be viewable through the cut-out window 40 of the bezel 36. This indicates the stars and the star constellations visible at that particular time on that particular day of the year.

If it happens to be the particular of night and day of year selected, the user properly orients himself using the directional information 48, such as by aligning the "North" directional information 48 imprinted on the bezel 36 with due "North", so that the planisphere map 28 is in proper alignment with the night sky. The internal edge of the crescent section 42 represents the horizon, and the user can determine the location of the various star constellations at that point.

Figure 6:
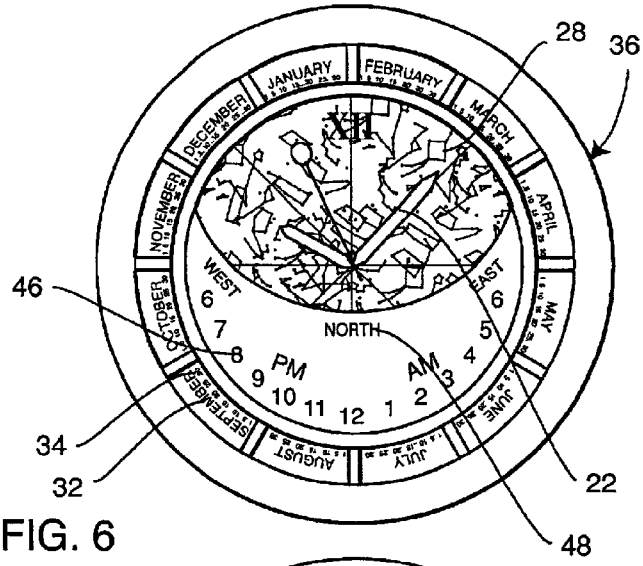
FIG. 6 is an enlarged top view of the bezel in a first selected time and date, rendering a portion of the planisphere map viewable through a window of the bezel.
Figure 7:
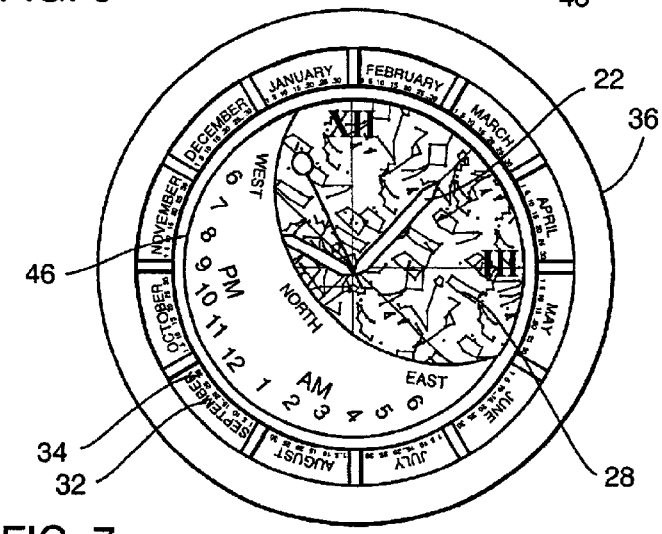
FIG. 7 is an enlarged top view of the bezel rotated to another date and time, revealing a different portion of the planisphere map.
Figure 8:
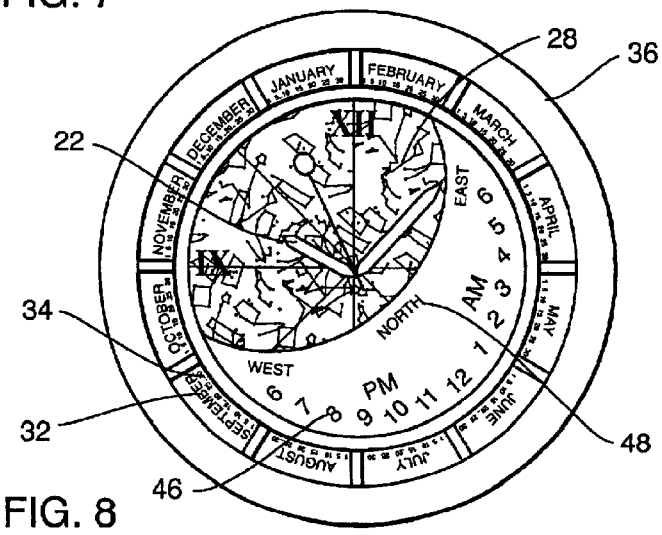
FIG. 8 is an enlarged top view of the bezel in yet another selected time and date position, rendering yet another portion of the planisphere map viewable through the bezel window.

Due to the fact that the planisphere map 28 will most likely be used at night, the dial 24 is preferably coated with a luminescent material so that the planisphere map indicia is viewable in the dark. Alternatively, the watch 10 may include a push button to activate an internal light as is well known in the art. FIGS. 6-8 illustrate the bezel 36 being rotated to different preselected times, or dates, showing that different portions of the planisphere map 28 are viewable through the cut-out window 40 depending upon the date and time selection. This is due to the fact that as the earth rotates different portions of the overall star constellation are viewable in the night sky. Thus, at 8 P.M. certain star constellations will be viewable in the night sky, whereas at 2 A.M. some of those star constellations will have passed beyond the horizon and new star constellations will be visible at that time. The present invention accommodates for the earth's rotation by the manual rotation of the bezel 36 as described above. The result is a planisphere watch 10 that not only tracks the current time, similar to other watches, but also enables the user to track the star constellation movement. This is done in a simple and inexpensive manner.

Although an embodiment has been described in detail for purposes of illustration, various modifications may be made without departing from the scope and spirit of the invention.

What is claimed is:

1. A planisphere watch, comprising:

a watch case including a transparent lens;

a time keeping mechanism disposed within the case and having a time display viewable through the lens;

planisphere indicia within the watch case and viewable through the lens;

a tension ring surrounding the lens and having date indicia thereon; and a movable bezel overlying the lens and defining a window through which a portion of the planisphere indicia is viewed, the bezel including time indicia alignable with the date indicia of the tension ring;

wherein upon rotating the bezel to align the selected time indicia with the selected date indicia, the planisphere indicia viewable in the night sky at the selected time and date is viewable through the bezel window.

2. The planisphere watch of claim 1, wherein the planisphere indicia comprises a map of star constellations and star systems.

3. The planisphere watch of claim 1, wherein the planisphere indicia is imprinted onto the lens.

4. The planisphere watch of claim 1, wherein the time display comprises a minute hand and an hour hand overlying a dial.

5. The planisphere watch of claim 4, wherein the planisphere indicia is imprinted onto the dial.

6. The planisphere watch of claim 4, wherein the dial is coated with a luminescent material.

7. The planisphere watch of claim 1, wherein the time indicia on the bezel consists of the hours of 6 PM through 6 AM spaced from one another.

8. The planisphere watch of claim 1, wherein the bezel includes directional information for orienting the planisphere indicia relative to the night sky.

9. The planisphere watch of claim 1, wherein the date indicia comprise months of the year in sequence, and preselected dates of each month.

10. The planisphere watch of claim 9, wherein the bezel includes an aperture alignable with a month of the tension ring.

11. The planisphere watch of claim 10, wherein the bezel includes a series of circumferential apertures, each aperture being aligned with a month of the tension ring.

12. A planisphere watch, comprising:

a watch case including a transparent lens;

a time keeping mechanism disposed within the case and having a time display viewable through the lens;

planisphere indicia comprising a map of star constellations and star systems within the watch case and viewable through the lens;

a tension ring surrounding the lens and having date indicia including months of the year and preselected dates of each month thereon; and a movable bezel overlying the lens and defining a window through which a portion of the planisphere indicia is viewed, the bezel including time indicia alignable with the date indicia of the tension ring, an aperture alignable with a month of the tension ring and directional information for orienting the planisphere relative to the night sky;

wherein upon rotating the bezel to align the selected time indicia with the selected date indicia, the planisphere indicia viewable in the night sky at the selected time and date is viewable through the bezel window.

13. The planisphere watch of claim 12, wherein the planisphere indicia is imprinted onto the lens.

14. The planisphere watch of claim 12, wherein the time display comprises a minute hand and an hour hand overlying a dial.

15. The planisphere watch of claim 14, wherein the planisphere indicia is imprinted onto the dial.

16. The planisphere watch of claim 14, wherein the dial is coated with a luminescent material.

17. The planisphere watch of claim 12, wherein the time indicia on the bezel consists of the hours of 6 PM through 6 AM spaced from one another.

18. The planisphere watch of claim 12, wherein the bezel includes a series of circumferential apertures, each aperture being aligned with a month of the tension ring.

19. A planisphere watch, comprising:

a watch case including a transparent lens;

a time keeping mechanism disposed within the case and having a time display including a minute hand and an hour hand overlying a dial viewable through the lens;

planisphere indicia comprising a map of star constellations and star systems printed onto the lens;

a tension ring surrounding the lens and having date indicia including months of the year and preselected dates of each month thereon; and a movable bezel overlying the lens and defining a window through which a portion of the planisphere indicia is viewed, the bezel including time indicia consisting of the hours of 6 PM through 6 AM spaced from one another and alignable with the date indicia of the tension ring, a series of circumferential apertures, each aperture being aligned with a month of the tension ring and directional information for orienting the planisphere relative to the night sky;

wherein upon rotating the bezel to align the selected time indicia with the selected date indicia, the planisphere indicia viewable in the night sky at the selected time and date is viewable through the bezel window.

20. The planisphere watch of claim 19, wherein the dial is coated with a luminescent material.

* * * * *